United States Patent [19]

Hansen et al.

[11] Patent Number: 4,584,845

[45] Date of Patent: Apr. 29, 1986

[54] CONTROL SYSTEM FOR LIQUID CHILLED BY AN EVAPORATOR

[75] Inventors: John C. Hansen, Spring Grove; Harold B. Ginder, York, both of Pa.

[73] Assignee: Borg-Warner Air Conditioning, Inc., York, Pa.

[21] Appl. No.: 750,205

[22] Filed: Jul. 1, 1985

[51] Int. Cl.[4] ..... F25D 17/02

[52] U.S. Cl. ..... 62/201; 62/228.1

[58] Field of Search ..... 62/201, 228.5, 228.1, 62/227, 217, 231, 157, 158, 161, 162, 163, 164

[56] References Cited

U.S. PATENT DOCUMENTS

| | | | |
|---|---|---|---|
| 4,201,061 | 5/1980 | Hefferman | 62/98 |
| 4,262,491 | 4/1981 | Chorey et al. | 62/229 X |
| 4,282,718 | 8/1981 | Kountz et al. | 62/115 |
| 4,535,607 | 8/1985 | Mount | 62/201 |
| 4,538,422 | 9/1985 | Mount et al. | 62/201 |
| 4,539,820 | 9/1985 | Zinsmeyer | 62/201 |

*Primary Examiner*—Harry Tanner

*Attorney, Agent, or Firm*—James E. Tracy

[57] ABSTRACT

To conserve energy in a large capacity refrigeration or air conditioning system, where liquid (usually water) is chilled by the system's evaporator and is then used to cool a building, the temperature setpoint of the chilled liquid leaving the evaporator may be reset upward from its desired level. Normally, if the temperature of the leaving chilled liquid falls below the setpoint by a fixed differential (such as 4° F.) to a cut-out temperature, the system's compressor is shut down as a safety precaution to prevent freeze-ups. A nuisance compressor shutdown may be avoided when the setpoint is reset to a higher level (since the actual temperature of the leaving chilled liquid at that time may be at or below the desired setpoint and may be more than 4° below the reset setpoint) by lowering the cut-out temperature to a fixed level substantially below the desired setpoint, such as down to 36° F. By maintaining the cut-out temperature at its reset level for a limited time (for example, ten minutes), the refrigeration system will be allowed to stabilize at the higher reset setpoint, after which the cut-out temperature is re-established at its normal level of 4° below the reset setpoint.

13 Claims, 2 Drawing Figures

CONTROL SYSTEM FOR LIQUID CHILLED BY AN EVAPORATOR

BACKGROUND OF THE INVENTION

This invention relates to a control arrangement for controlling the chilled liquid temperature in a refrigeration system, of the type having a liquid chiller, in order to minimize energy consumption while avoiding inefficient and detrimental on-off cycling of the system.

Large commercial and industrial air conditioning systems typically employ centrifugal liquid chillers. As the refrigerant flows through the system's evaporator, circulating liquid (usually water), which is in heat exchange relationship with the refrigerant, transfers heat to the refrigerant. The chilled liquid leaving the evaporator is then delivered to remote locations and used to cool a building or a zone. By maintaining the temperature of the leaving chilled liquid at a desired setpoint, the cooled space may be held at a desired temperature. The required control is usually accomplished by adjusting the position of the guide vanes or prerotation vanes, at the inlet of the system's centrifugal compressor, in response to the leaving chilled liquid temperature which is sensed. Adjusting the prerotation vanes varies the capacity of the centrifugal compressor, which in turn changes the refrigeration capacity of the system. Normally, the prerotation vanes will be adjusted, under the control of the sensed temperature, so that the leaving chilled liquid will remain close to or slightly below the desired setpoint. If the temperature of the chilled liquid drops below the setpoint by a fixed differential (such as by 4° F.), the cooling load will be satisfied and the unit will be cycled off; specifically the motor driving the compressor will be de-energized thereby shutting the compressor down. (All temperatures mentioned herein will be F. or Fahrenheit.) This low temperature (4° below the setpoint) is called the cut-out temperature or the low water temperature cut-out (LWT) when water is employed in the chiller. Cycling off at the cut-out temperature not only conserves energy but is a safety precaution to prevent freeze-ups.

To provide additional energy savings, many users of centrifugal chillers employ devices such as building energy management systems to reset the chilled liquid setpoint upward during periods of light load and/or heavy electrical demand. If the new reset setpoint is higher than the old desired setpoint by an amount greater than the 4° fixed differential, the unit will cycle off since the actual liquid (water) temperature will be less than the new LWT setting or the reset cut-out temperature. For example, assume that the desired setpoint is 50°. Under normal conditions the water will be cooled down to 46° before the chiller is cycled off. As the water warms up the unit will restart at the setpoint (50°) so that the water temperature will be maintained between 46° and 50°. Assume now that the building energy management system resets the setpoint to 58°, the new cut-out or LWT therby being 54°. Since the water temperature will be between 46° and 50°, and thus below the new LWT, when the system is reset, the centrifugal compressor will be shut down immediately upon reset. This will be a nuisance trip or shutdown.

Frequent stopping and starting of the centrifugal compressor and its driving motor is not recommended and is not energy efficient. This stresses the motor and shortens its life. Stopping and restarting the centrifugal liquid chiller unit by reset of the leaving water temperature setpoint is thus detrimental.

This shortcoming of the prior reset systems for the leaving chilled liquid has now been overcome by the present invention. Resetting is achieved without causing undesirable nuisance shutdowns, thereby maximizing energy savings and efficiency and extending the motor life.

SUMMARY OF THE INVENTION

The invention provides a control system for a refrigeration system having an adjustable capacity compressor, a condenser, and an evaporator through which chilled liquid is circulated. The control system comprises sensing means for sensing the temperature of the chilled liquid leaving the evaporator. Regulating means, which responds to the sensed temperature, regulates the capacity of the compressor as necessary to maintain the leaving chilled liquid at a desired temperature setpoint, for example 48°. Means, which also responds to the sensed temperature, shuts the compressor down whenever the temperature of the leaving chilled liquid drops below the setpoint, by a fixed differential (such as 4°), to a cut-out temperature level, namely, whenever the temperature falls to 44° in the example. There are means for providing a reset temperature signal representing a predetermined increase (for example, a 7° increase) in the temperature setpoint. Reset means, which responds to the reset temperature signal, resets the setpoint upward to a reset level (namely, from 48° to 55°), while at the same time shifting the cut-out temperature downward to a reset value (for example, 36°) to avoid a nuisance shutdown of the compressor when the setpoint is reset. The reset means maintains the cut-out temperature at its reset level for a predetermined time period (such as ten minutes) to allow the refrigeration system to stabilize at the reset setpoint, after which the cut-out temperature is raised to its normal level which is less than the reset setpoint (55°) by the fixed 4° differential.

DESCRIPTION OF THE DRAWINGS

The features of the invention which are believed to be novel are set forth with particularity in the appended claims. The invention may best be understood, however, by reference to the following description in conjunction with the accompanying drawings in which:

DESCRIPTION OF THE ILLUSTRATED EMBODIMENT

Figure 1:
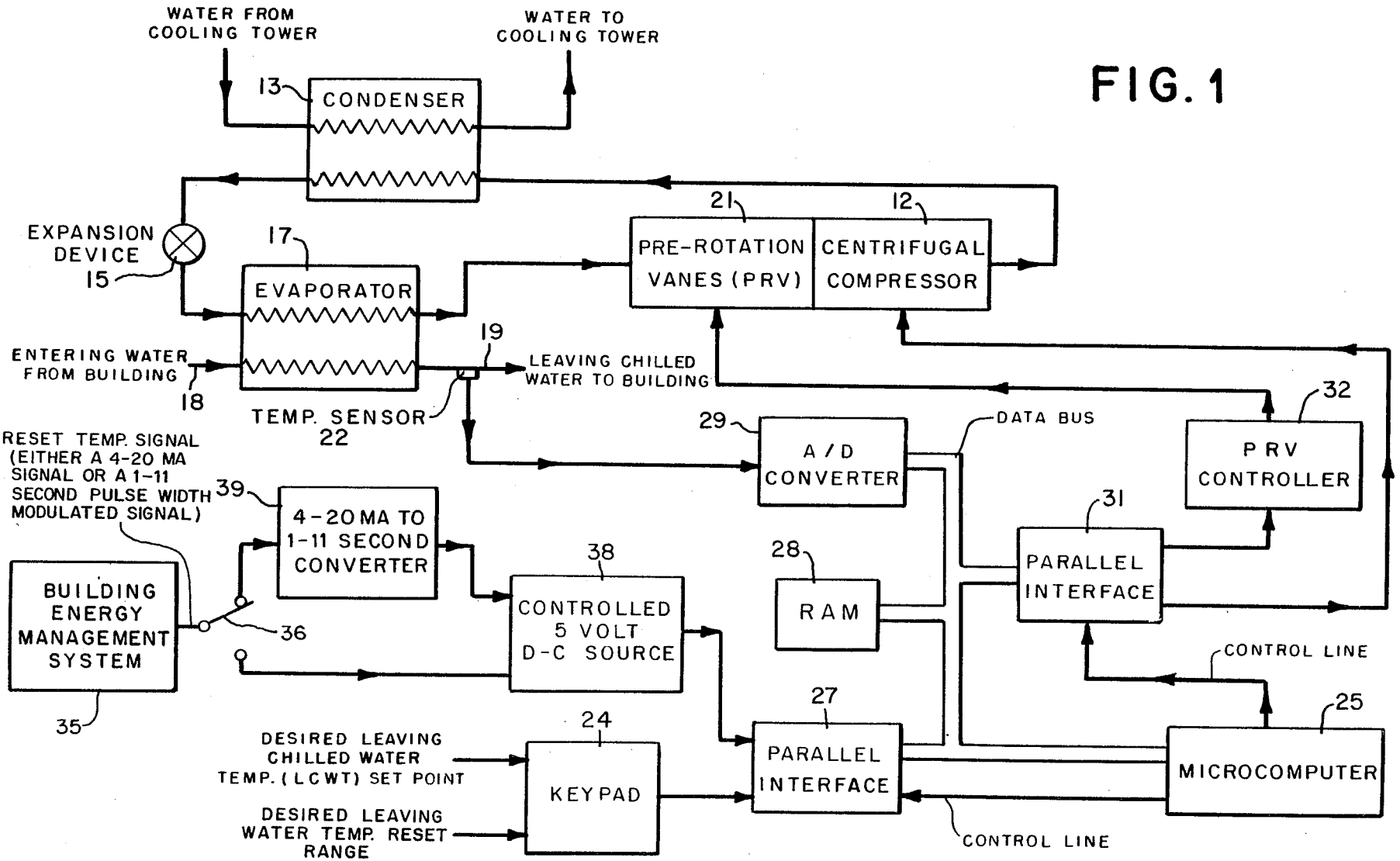
FIG. 1 is a block diagram illustrating an air conditioning system having a control system constructed in accordance with one embodiment of the invention; and, FIG. 2 is a flow chart illustrating the logic sequence of operations and decisions which occur in operating the control system.

FIG. 1 depicts the major components of an air conditioning system of the type having a centrifugal liquid chiller unit. Centrifugal compressor 12 discharges compressed refrigerant which flows through condenser 13 where it condenses and cools by transferring heat to the water which circulates between the cooling tower and the condenser. From the condenser 13 the refrigerant passes through the expansion device 15 and then through the evaporator 17 to the inlet of the centrifugal compressor. Liquid (specifically water in the illustrated embodiment) is received from the building (or other cooling load) over line 18 and flows through a heat exchange coil in the evaporator, after which it exits through line 19 for return to the building which may be remotely located from the evaporator. The water is chilled as it flows through the coil in evaporator 17, transferring heat to the refrigerant. After leaving the evaporator on line 19, the chilled water is employed to cool the building in any well-known manner. For example, air handlers or fan coil units may be used in which fans blow room air over coils through which the chilled water flows. The inlet of compressor 12 comprises adjustable guide vanes or prerotation vanes (PRV) 21 to regulate the quantity of refrigerant flowing through the compressor. The capacity of the compressor is adjusted by varying the position of the prerotation vanes.

Temperature sensor 22, which may be a thermistor, is positioned to sense the temperature of the chilled water leaving the evaporator 17 and produces an electrical analog signal which is proportional to and representative of the present actual measured temperature. Microcomputer-based control apparatus, which operates in response to the temperature sensed by sensor 22, is provided to control the prerotation vanes 21 to regulate the capacity of the compressor 12 as necessary to maintain the leaving chilled water at a desired temperature setpoint. More specifically, the desired leaving chilled water temperature (LCWT) setpoint information is entered into the computer program by operating keypad 24. Microcomputer 25 may be of the type manufactured by Intel and designated by the number 8051. That particular microcomputer includes a ROM (read only memory) sufficient to permanently store the required program. As the microcomputer 25 executes its program, the desired setpoint information punched or entered into the keypad 24 will be conveyed through parallel interface 27 and over the data bus to the RAM (random access memory) 28 wherein the information is stored. When a certain step is reached in the program, a signal is fed over the control line (between microcomputer 25 and parallel interface 27) which effectively causes the setpoint information to be sent over the data bus to RAM 28 for storage.

Parallel interface 27 may be a type 146823 made by Motorola and functionally can input data to or output data from the microcomputer based upon the state of its control line fed from the microcomputer. Actually, such a Motorola parallel interface is capable of handling a much larger number of inputs than needed to implement the present invention. This facilitates the monitoring and control of other parameters in the air conditioning system, which has not been shown to avoid unduly encumbering the patent application. For example, the pressure of the refrigerant in the condenser and in the evaporator, the temperature of the refrigerant at the compressor discharge, the oil temperature, the entering and leaving water temperatures in the condenser, and the motor current may all be monitored for control and safety reasons. The several inputs or ports of parallel interface 27 may be interrogated by the microcomputer one at a time or in groups.

The analog output signal of temperature sensor 22 is converted into a digital signal (namely, a binary number) by analog-to-digital converter 29 and applied to the data bus. Under the control of microcomputer 25, at a predetermined step in the program sequence the digital information will be polled and fed to RAM 28 for storage.

Parallel interface 31 is preferably of the same type as interface 27 and is provided to transfer information to compressor 12 and to PRV controller 32 which controls the positioning of the prerotation vanes to control the compressor capacity. Interface 31 accepts information from the data bus that is generated by microcomputer 25. The control line between the microcomputer and parallel interface 31 determines when information is sent to PRV controller 32 or to compressor 12.

As thus far described, the refrigerantion system is conventional and one skilled in the art may easily program microcomputer 25 to control the compressor capacity to hold the leaving chilled water at the desired temperature setpoint. As the microcomputer is sequenced through its program, the information provided by A/D converter 29 (which represents the actual temperature of the leaving chilled water) will be effectively compared with the desired setpoint information, registered in keypad 24 and stored in RAM 28, and from the comparison an appropriate control signal will be sent to PRV controller 32 in order to adjust the prerotation vanes to the setting required to maintain the temperature of the leaving chilled water relatively constant and at the desired setpoint. In the event that no desired setpoint is registered in keypad 24 and inputed to RAM 28, microcomputer 25 will preferably be programmed with a default value for the leaving chilled water temperature (or LCWT) setpoint. For example, the default value may be set at around 45°.

The desired low water temperature cut-out (LWT), which lies below the setpoint temperature by a fixed differential of 4°, may also be programmed into microcomputer 25. Whenever the comparison determines that the actual leaving chilled water temperature (LCWT) is at least 4° less than the desired setpoint, a cut-out signal is sent to compressor 12 to de-energize the compressor motor thereby shutting the compressor down.

Turning now to the invention, the building energy management system 35 provides, at its output, a reset temperature signal which will effect resetting of the temperature setpoint to a higher value to reduce the energy consumption by the refrigeration system. Typical energy management systems will output, when energy is to be reduced, either a four to twenty milliamp (mA) current signal or a one to eleven second pulse width modulated (PWM) signal, the specific values within the ranges being determined by the extent of the desired power reduction, which is determined by the adjustment of the energy management system. In other words, if the reset temperature signal takes the form of a current signal, it will have a magnitude of 20 milliamps for maximum energy savings and 4 milliamps for minimum energy savings. If the reset signal comprises a series of pulses (namely, a PWM signal), each pulse will have a duration or width of 11 seconds for maximum power reduction and one second for minimum reduction. If the reset temperature signal constitutes a pulse width modulated signal, switch 36 is positioned to its opposite position as shown in FIG. 1 and the PWM signal is applied directly to the controlled 5 volt d-c source 38. On the other hand, if the reset signal is a 4–20 mA current signal it is applied through switch 36 to the 4–20 mA to 1–11 second converter 39 where it is converted to its corresponding 1–11 second PWM signal. Actually, each signal pulse received by controlled d-c source 38 may be merely a contact closure within system 35. Contacts may be closed for one second or up to eleven seconds.

Controlled 5 volt d-c source 38 is provided to effectively convert every applied signal pulse from either system 35 or converter 39 to a pulse of 5 volts d-c of the same duration as the applied pulse. This is necessary so that voltage pulses of the appropriate level are delivered from source 38 to parallel interface 27.

The value of the reset temperature signal (namely, either its amplitude when it is a 4–20 mA signal or its pulse width when it is a 1–11 second PWM signal) determines the relative extent of energy savings between a minimum and a maximum, but the specific amount by which the setpoint is raised by that reset signal depends on reset range information that must be programmed into the system. More particularly, as indicated in FIG. 1, the operator must register into keypad 24 the desired maximum temperature reset range for the leaving water. As the microcomputer 25 steps through its program, the reset range information entered into keypad 24 will flow through parallel interface 27 and the data bus and will be stored in RAM 28. Preferably, two different ranges are employed—10° and 20°. When the 10° range is selected, a reset signal having a 20 mA amplitude or a pulse width of 11 seconds will equate to the maximum 10° increase in the temperature setpoint, while a 4 mA amplitude or a one second pulse width will correspond to a zero increase in the setpoint. A reset signal between its limits corresponds to a proportional increase. Similarly, when the 20° range is selected, an 11 second pulse or a 20 mA current signal equates to the full 20° increase in the setpoint, and a one second pulse or a 4 mA signal corresponds to no increase, the values in between corresponding to proportional setpoint increases. For example, if the 20° reset range is selected and is registered in keypad 24, a reset signal having a 9 second pulse or a 12.8 mA amplitude results in a reset increase or offset of 16°, the setpoint thereby being raised 16° above its desired value. This is determined by the following equation:

$$\text{Offset} = \frac{(\text{reset pulse width} - 1) \times \text{reset temperature range}}{(11 - 1 \text{ second pulse range})}$$

$$\text{Offset} = \frac{(9 - 1) \times 20}{10} = 16^\circ \text{ F.}$$

In the event that no reset range information is entered into key pad 24 and stored in RAM 28, or in the event that that information is erased from the RAM for some reason, a default reset range value will be permanently stored in the ROM in microcomputer 25. Preferrably, that default value will be 20° F.

Figure 2:
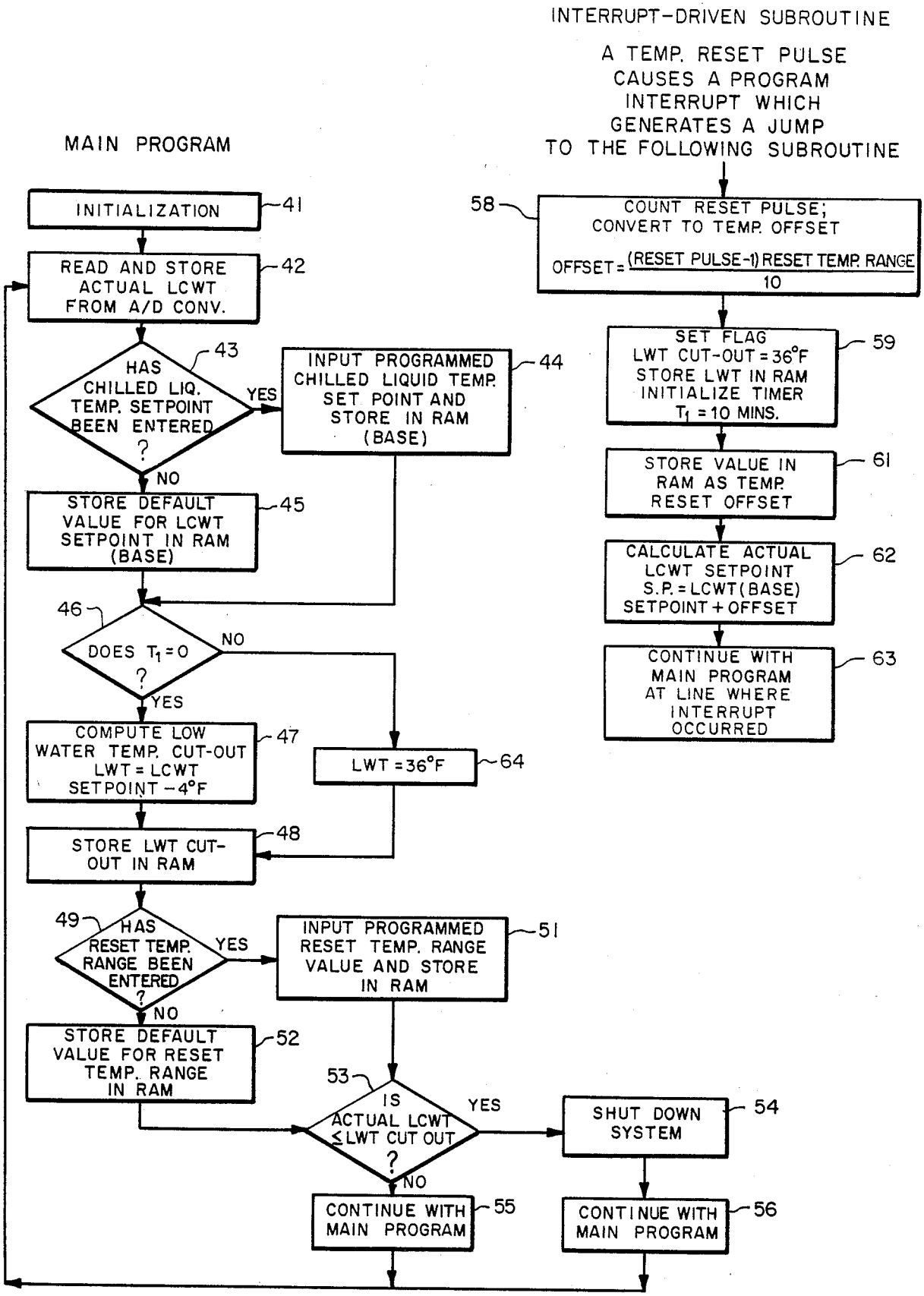

The operation of the invention may be more fully understood with the aid of the flow chart of FIG. 2 which depicts the portion of the microcomputer's program dealing with the resetting of the leaving chilled water temperature setpoint. As mentioned previously, the computing system is capable of monitoring and controlling several parameters in the refrigeration system. Some of these parameters may be sensed for safety reasons and appropriate steps may be taken when those parameters fall outside of their desired limits. Hence, when all of the contemplated functions are included, the complete program for microcomputer 25 will be substantially greater than that illustrated in FIG. 2.

Referring now to block 41 of the main program shown in FIG. 2, application of power to the control system effects initialization or power-up and all of the components are set to desired states. The program then steps to operation or instruction block 42 to read the actual value of the leaving chilled water temperature (or LCWT) as outputed by the A/D converter 29. This binary number is then stored in RAM 28. Functionally, decision block 43 determines whether a chilled liquid (water) temperature setpoint has been entered by the operator. If so, the desired setpoint value is stored in RAM 28 as the base setpoint (see operation block 44). If the desired setpoint has not been programmed or has been erased (for example, if there is a power failure and there is no back-up power supply), a default value (preferably 45°, as mentioned hereinbefore) for the setpoint will be stored in the RAM, as indicated by block 45.

Assuming that there is no reset temperature signal at this time (namely, there is no command from energy management system 35 to reduce the energy consumption), timer $T_1$ in the microcomputer will be at its zero count, for reasons to be understood, and the YES exit of decision block 46 will be taken to block 47 whereupon the low water temperature cut-out (LWT) will be calculated, that cut-out temperature level being 4° less than the leaving chilled water temperature setpoint. This LWT cut-out temperature is then stored in RAM 28 (see block 48). Thereafter, decision block 49 inquires as to whether a desired leaving water temperature reset range has been entered into keypad 24 by the operator. If yes, the desired reset range (which will be either 10° or 20°) will be stored in the RAM (see block 51). If the value of the reset range has not been programmed, a default value of 20° as noted earlier will be stored in RAM 28, as indicated by block 52.

In another portion of the computer program, the actual value of the LCWT (represented by the output of converter 29) will be compared with the setpoint stored in the RAM and controller 32 will control the prerotation vanes in the manner required to hold the LCWT at the desired setpoint. If the cooling load is satisfied and the actual temperature of the leaving chilled water drops down to the LWT cut-out, decision block 53 in the flowchart will make that determination and will effect shutdown of the system, specifically shutdown of compressor 12, as indicated by block 54. If the actual LCWT is above the LWT cut-out, the main program will continue (block 55) to, among other things, check various other safety parameters. Of course, even if the compressor is turned off, the main program will also continue as indicated by block 56.

Assume now that the building energy management system outputs a reset temperature signal, thereby resulting in the application of a 5-volt reset pulse, of a selected duration from one to eleven seconds, to parallel interface 27. This pulse is transmitted through interface 27 to the interrupt line of the microcomputer 25. The interrupt causes the program to call its interrupt-driven subroutine of FIG. 2 which begins with operation block 58. The interrupt line is counted by the timer in the program which continues until the reset pulse on the interrupt line ends. The reset pulse is counted as a time in seconds and converted to the reset temperature offset in accordance with the equation discussed previously. This offset, when added to the desired LCWT setpoint, will be the new value or the reset value for the setpoint.

Since a reset pulse has now been received, it is necessary to set the low water temperature cut-out (LWT) to 36° for ten minutes to avoid nuisance system shutdowns and to permit the system to stabilize under the new operating conditions, namely at the new setpoint. Block 59 begins this sequence by setting the reset cut-out temperature or LWT at 36° and initializing the timer $T_1$ to ten minutes such that when it counts down to zero the LWT can be set to its normal value. Block 61 stores the temporary value of the LWT in the RAM. The offset, when added to the LCWT (base) setpoint, will be the new value or reset level of the setpoint (block 62). Block 63 returns the main program to the point at which it left when the interrupt was generated.

Re-entering the main program at block 46, during the ten minute stabilizing interval the timer $T_1$ will not be at its zero count and the NO exit of block 46 will be followed to block 64 which maintains the LWT cut-out at 36°. The ten minute period provides ample time for the system to stabilize at the new higher reset setpoint and during this time the system will not be tripped off because the LWT is substantially reduced from its normal level. When the ten minutes have elapsed, the timer will be at its zero count and the YES exit of block 46 will be taken to block 47 wherein a calculation is made to determine the new LWT value which will be 4° below the reset setpoint determined by block 62. As long as a reset temperature signal is issued by building energy management system 35, after the ten minute stabilizing period the LWT will return to its normal 4° differential below the setpoint, which, of course, remains at its high reset value as determined by the value of the reset temperature signal and by the value of the temperature reset range.

While the LCWT setpoint is reset under the control of an energy management system in the illustrated embodiment, it will be recognized that the system will function in response to any remote input that raises the setpoint.

It should also be appreciated that while the illustrated control system is microcomputer based, the invention could be implemented instead with other integrated circuits or even with discrete circuit components.

While a particular embodiment of the invention has been shown and described, modifications may be made, and it is intended in the appended claims to cover all such modifications as may fall within the true spirit and scope of the invention.

We claim:

1. A control system for a refrigeration system having an adjustable capacity compressor, a condenser, and an evaporator through which chilled liquid is circulated, comprising:

sensing means for sensing the temperature of the chilled liquid leaving the evaporator;

regulating means, responsive to the sensed temperature, for regulating the capacity of the compressor as necessary to maintain the leaving chilled liquid at a desired temperature setpoint;

means, responsive to the sensed temperature, for shutting the compressor down whenever the temperature of the leaving chilled liquid drops below the setpoint, by a fixed differential, to a cut-out temperature level;

means for providing a reset temperature signal representing a predetermined increase in the temperature setpoint;

and reset means, responsive to said reset temperature signal, for resetting the setpoint upward to a reset level, while at the same time shifting the cut-out temperature downward to a reset value to avoid a nuisance shutdown of the compressor when the setpoint is reset.

2. A control system according to claim 1 wherein the difference between the reset setpoint and the reset cut-out temperature is substantially greater than said fixed differential.

3. A control system according to claim 1 wherein the reset cut-out temperature is a fixed value slightly above the freezing temperature of the chilled liquid.

4. A control system according to claim 1 wherein the chilled liquid is water and the reset cut-out temperature is around 36° F.

5. A control system according to claim 1 wherein the reset setpoint is variable, as determined by the desired temperature setpoint and by the reset temperature signal, whereas the reset cut-out temperature is fixed at a level well below the desired temperature setpoint.

6. A control system according to claim 1 wherein said reset means maintains the cut-out temperature at its reset level for a predetermined time interval to allow the refrigeration system to stabilize under the new operating conditions.

7. A control system according to claim 1 wherein said regulating means, after the setpoint is reset, adjusts the capacity of the compressor to establish and to hold the leaving chilled liquid at the reset setpoint.

8. A control system according to claim 1 wherein said reset means maintains the cut-out temperature at its reset level for a predetermined time period to allow the refrigeration system to stabilize at the reset setpoint, after which the cut-out temperature is raised to a level which is less than the reset setpoint by said fixed differential.

9. A control system according to claim 1 wherein said reset temperature signal has a characteristic that may be varied to select any temperature increase within a prescribed range.

10. A control system according to claim 9 wherein said prescribed range may be selected from a plurality of different ranges.

11. A control system according to claim 1 wherein said reset temperature signal is provided by a building energy management system, resetting the setpoint upward from the desired setpoint resulting in energy savings.

12. A control system for a refrigeration system having a compressor, a condenser and an evaporator through which chilled liquid is circulated, and wherein the capacity of the refrigeration system is regulated to maintain the chilled liquid leaving the evaporator at a desired temperature setpoint, the compressor being shutdown as a safety precaution any time the temperature of the leaving chilled liquid falls below the setpoint, by a fixed differential, to a cut-out temperature, said control system comprising:

reset means for resetting the setpoint upward to reduce energy consumption, while at the same time lowering the cut-out temperature to avoid a nuisance compressor shutdown when the setpoint is reset.

13. A control system according to claim 12 wherein said reset means maintains the cut-out temperature at its reset level for a limited time to allow the refrigeration system to stabilize at the reset setpoint, after which the cut-out temperature is increased so that it will lie below the reset setpoint by said fixed differential.

* * * * *